United States Patent [19]

Wright

[11] Patent Number: 4,599,806

[45] Date of Patent: Jul. 15, 1986

[54] CARPENTER'S SQUARE AND PROTRACTOR

[76] Inventor: Randall J. Wright, 2000 Moraine End, Delafield, Wis. 53018

[21] Appl. No.: 697,139

[22] Filed: Feb. 1, 1985

[51] Int. Cl.[4] ..... B43L 7/06

[52] U.S. Cl. ..... 33/469; 33/470

[58] Field of Search ..... 33/468, 469, 470, 471, 33/473, 497, 499, 500

[56] References Cited

U.S. PATENT DOCUMENTS

| | | | |
|---|---|---|---|
| 506,416 | 10/1893 | Colley | 33/470 |
| 1,295,180 | 2/1919 | Lowenstein | 33/470 |
| 1,606,192 | 11/1926 | Sisson | 33/470 |
| 2,611,185 | 9/1952 | Thursack | 33/469 |
| 3,102,340 | 9/1963 | Rackleff | 33/473 |
| 3,273,246 | 9/1966 | Siberini | 33/470 |
| 4,348,815 | 9/1982 | Hurt | 33/470 |
| 4,525,933 | 7/1985 | Patterson | 33/470 |

FOREIGN PATENT DOCUMENTS

| | | | |
|---|---|---|---|
| 202268 | 4/1939 | Switzerland | 33/468 |

*Primary Examiner*—Richard R. Stearns

*Attorney, Agent, or Firm*—Quarles & Brady

[57] ABSTRACT

An improved carpenter's square and protractor which can accurately duplicate a desired angle onto a surface to be cut. Accurate duplication of the desired angle is accomplished by a unique securing of the T-head on a bladed ruler wherein a securing by the draw bolt adjustment is accomplished in a transverse manner with respect to the plane of rotation of the T-head and the ruler member. In order to provide for center location of the draw bolt adjustment, a slide member which receives the ruler member is positioned in an offset manner with angular arm members. The T-head is multifunctional in that it not only provides a simplified protractor function with respect to the ruler but it also affords a supporting wall member onto which projections can be placed so that this device can be utilized to locate the centers of large circular objects. In addition, the T-head can so accommodate a level vial as well as a plumb vial.

16 Claims, 6 Drawing Figures

CARPENTER'S SQUARE AND PROTRACTOR

BACKGROUND OF THE INVENTION

This invention relates to a carpenter's square and protractor which can accurately duplicate an angle onto a surface. More particularly, it relates to a combined square and protractor for use with the layout and cutting of large panelling in which the T-head of the square is secured with respect to the center of the ruler so that an accurate angular relationship is at all times maintained between the T-head surface edge and the intersecting ruler edge, as well as providing a supporting wall surface so that projections can extend therefrom thereby providing a means of locating the center of a large circle, such as a table.

Carpenter's squares which are currently available and which also provide a protractor function usually employ a center slotted ruler with a protractor element rotatively mounted thereon and with a draw bolt adjustment to the side of the ruler with a lug-like element positioned in the slot. Tightening of the draw bolt maintains the flat straight edge surface of the protractor element in any desired angular relationship to the ruler surface. A problem arises with the lateral or transverse attachment of the protractor element to the ruler in that when an accurate angular relationship is required, a tightening of the adjustment bolt from one side can cause an undesired movement between the straight edge of the protractor and the straight edge of the ruler thereby preventing accurate duplication of the desired angle onto the work surface. The foregoing problem becomes even more magnified when large surfaces are worked upon or cut such as with panel board. It is obvious that a minor discrepancy between the T-head and the ruler portion of the square when projected over several feet can result in a major error and problem in marking and cutting the board at the desired angle. Further, many carpenter's protractor squares involve the use of dual adjustment and tightening screws thus adding to the cost of the unit.

It is an advantage of the present invention to provide an improved combination carpenter square and protractor. It is an additional advantage of this invention to provide a device of the aforementioned type wherein the protractor portion of the square is secured to the ruler portion in a manner such that a distortion of the protractor straight edge surface with respect to the ruler edge surface is avoided upon tightening the two elements together. Other advantages are a tool of the aforementioned type which will also provide a unique slide arrangement between the protractor element and the ruler; a means of providing a center locating device for circular surfaces such as round tables; an improved combination panel square and protractor which affords both level vials and plumb vials in the T-head cross member and also affords attachment of an additional protractor dial for determining angular relationships separate from the square and protractor.

SUMMARY OF THE INVENTION

The foregoing advantages are accomplished and the shortcomings of the prior art are overcome by the improved combination square and protractor wherein a first member preferably in the form of a ruler blade has a flat surface along a longitudinal axis and at least one straight edge. A second member preferably in the form of a T-head member has a longitudinal axis and also a straight edge. Rotatable protractor means are operatively associated with the first and second members and provide rotation in a given plane. Draw bolt adjustment means are operatively positioned with respect to the first and second members and in a substantially transverse manner with respect to the plane of rotation. In a preferred manner, the draw bolt adjustment means are provided by slot means operatively positioned in the ruler blade member with the slot means being of a T-shaped configuration. A bolt having a head with a similar T-shaped configuration in cross section is positioned in the slot. The T-head member includes a stationary protractor scale with a rotatable member mounted in the head member and a slide member positioned outwardly from the rotatable member for reception of the blade member in a centered manner yet off-set manner with respect to a connection of the bolt and nut of the draw bolt means. Also preferably, the blade member is of a beveled blade type with opposing straight edges, a central flat portion and angular portions extending therebetween. The slide member extending from the rotatable member has two outwardly angular arm members and an interconnecting arm member with the arm members constructed and arranged to accommodate the beveled blade between the slide member and the rotatable member. The T-head member is formed with an extending wall which provides a flat straight edge surface as well as paired projections extending therefrom which serve as center finding means. Also, the head member wall can accommodate a level vial and a plumb vial with respect thereto in the head member. The blade member can also accommodate additional devices such as an angle indicating means in the form of a protractor dial.

BRIEF DESCRIPTION OF THE DRAWINGS

A better understanding of the improved square and protractor device of this invention will be accomplished by reference to the drawings wherein.

DESCRIPTION OF THE PREFERRED EMBODIMENT

Figure 1:
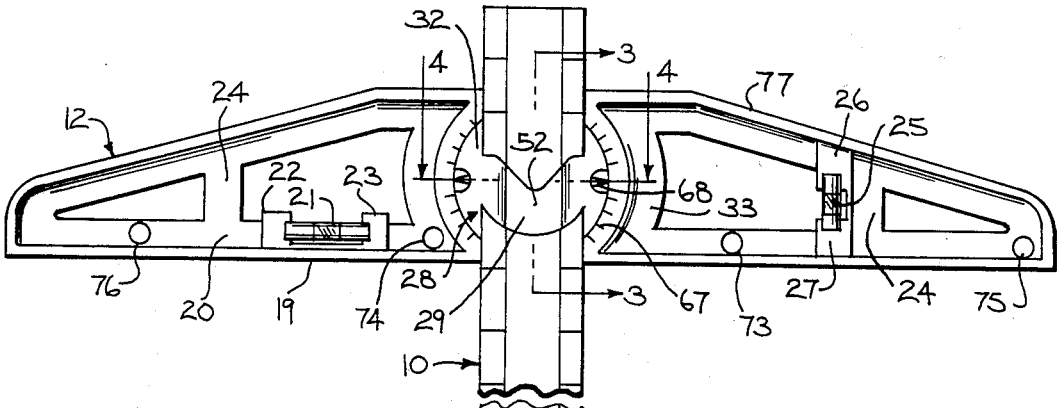
FIG. 1 is a perspective view showing the improved combination square and protractor of this invention with a T-head member as well as an additional protractor dial device attached thereto.

Proceeding to a detailed description of the preferred embodiment of the invention, and particularly FIGS. 1-4, the improved combination layout square and protractor device generally 10 includes a ruler member generally 11 for slidable engagement with the T-head member generally 12. Also positioned on the ruler member 11 but not forming a part of this invention is a well-known protractor square 13. It is illustrated merely to show the versatility of the improved square and protractor device 10 and lateral tightening of a draw bolt.

Protractor square 13 will include the usual square head 56 with a level vial 57 and a protractor dial 55.

The ruler member 11 includes the usual straight edge 14 with a straight edge 15 on the opposing side and a raised central portion 16 therebetween. In the preferred embodiment, the central portion 16 is flat and the shoulder portions 17 and 18 angle therefrom and toward the straight edges 14 and 15. This is best seen in conjunction with FIG. 4.

The T-head member 12 is of a beam-like construction and includes a straight edge or working surface 19 as well as a wall portion 20 to which is connected support members 22 and 23 for level vial 21. Extending transversely thereto are wall portions 24 which interconnect with upper angular beam portion 77. Disposed in a manner similar to wall portions 24 are support members 26 and 27 for a second level vial 25. Positioned centrally in the T-head member 12 is a protractor means generally 28 which includes markings 67 on a central housing portion 33 and arrow-like markings 68 on circular rotatable body member 32 as well as a slide member 29 for positioning over the ruler member 11.

Figure 2:
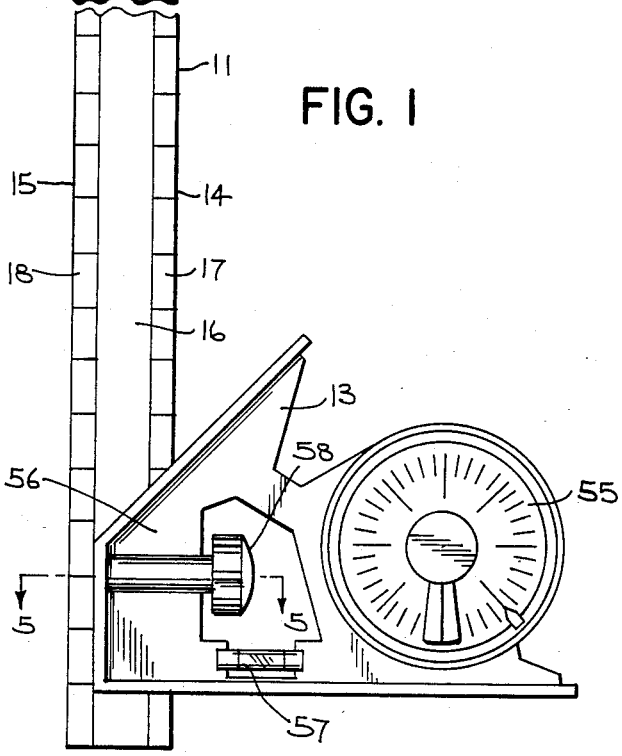
FIG. 2 is a back elevational view showing the T-head member of FIG. 1.
Figure 2:
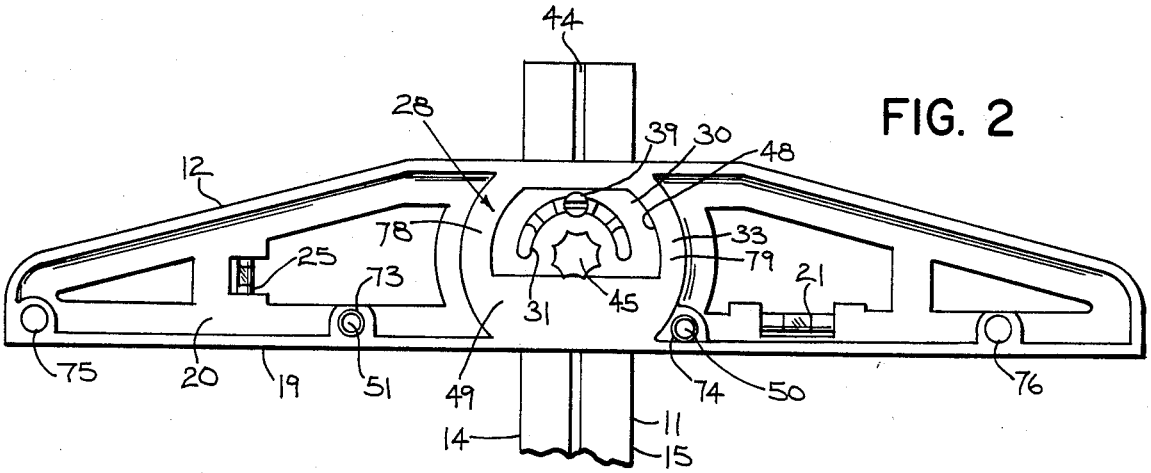
Figure 4:
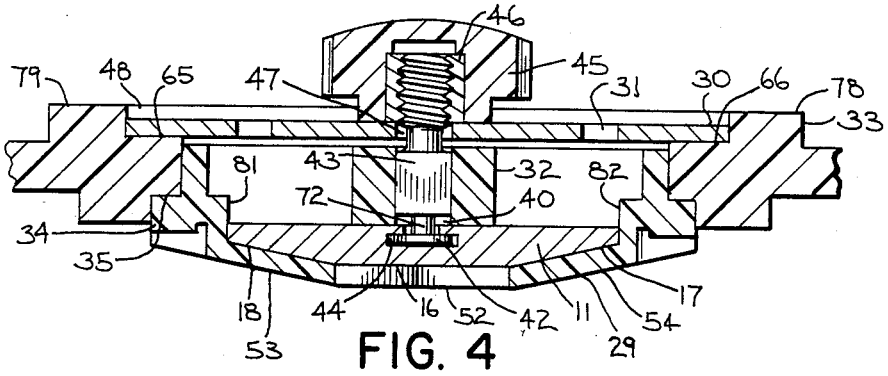
FIG. 4 is a view in horizontal section taken along line 4—4 of FIG. 1.

Referring specifically to FIG. 2, the protractor means 28 also includes a guide plate 30 housed in a compartment 48 bordered by arcuate walls 78 and 79 and base wall 49. This will be further explained in conjunction with FIGS. 3 and 4. Guide plate 30 has a guide slot 31 in which rides adjustment screw 39. Also in contact with the guide plate 30 is a bolt knob 45.

Figure 3:
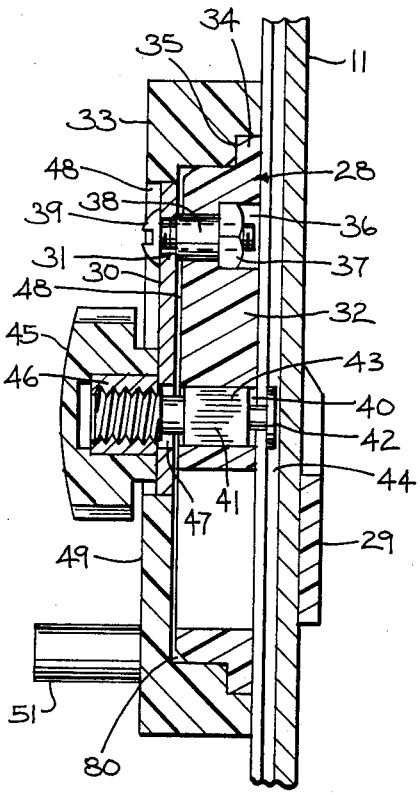
FIG. 3 is a view in vertical section taken along line 3—3 of FIG. 1.

Referring specifically to FIG. 3, it will be seen that a circular body member 32 of the protractor means 28 is rotatably received in a circular compartment 80 of the circular housing 33 which includes a shoulder 35 for supporting a flange 34. The rotatable member 32 includes a compartment 36 which nonrotatably receives the nut 37 having a threaded neck 38 which is accommodated within a continuous passage of the body portion 32. The screw 39 passes through the guide slot 31 of the guide plate 30 and engages the nut 37. A second compartment 40 is also disposed in the rotatable member 32 for accommodating a bolt 41 having a guide block 43 from which extends a circular head 42 for slidable engagement in the slot 44 of the ruler member 11. The combined nut and knob 45 engages the bolt 41 by means of a threaded insert 46. An aperture 47 is provided through the guide plate 30 in order to accommodate the bolt 41. For purposes of illustration, a projection 51 extends from the back side of the T-head member 12 and from aperture 73 for purposes to be explained in conjunction with FIG. 6.

The housing 33 also includes an outer compartment 48 defined by the two arcuate shoulder members 65 and 66 for seating of the guide plate 30 thereagainst. This is best seen in conjunction with FIG. 4 wherein it will also be noted that the slide member 29 has a central wall portion 52 and two angled and outwardly extending wall portions 53 and 54 to accommodate the raised central portion 16 and the angled shoulder portions 17 and 18 of the ruler member 11. The T-shaped slot 44 in the ruler member 11 is also best seen in this particular Figure as is the T-shaped head 42 and the neck 72 of the bolt 41.

Figure 5:
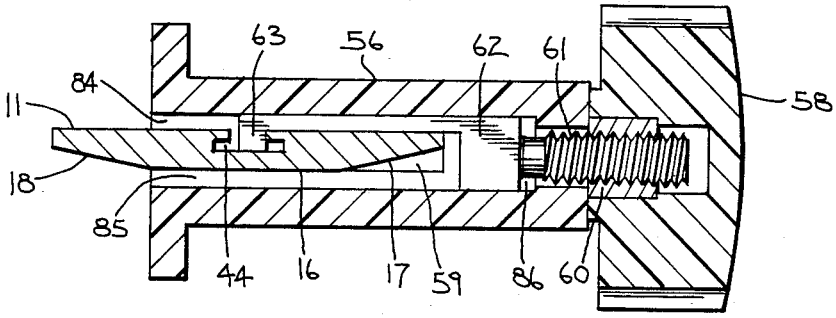
FIG. 5 is a view in horizontal section taken along line 5—5 of FIG. 1.

Referring to FIG. 5, a draw bolt knob 58 is therein indicated which forms a part of the draw bolt adjustment assembly for attaching the protractor square 13 to the ruler member 11. As indicated earlier, these components are standard and include a slot-like cavity 59 in the square head 56 for receiving the ruler member 11. Two U-shaped grooves 84 and 85 extend outwardly from the cavity 59 to receive a generally L-shaped bolt body 62 which is slidably received therein as well as in the rectangular cavity portion 86 in the square head 56 which is continuous with the U-shaped grooves 84 and 85. Bolt body 62 has a projection 63 for engagement in the T-shaped slot 44 of the ruler member 11. The threaded section 61 extends from the bolt body 62 for engagement with the threaded insert 60 in the draw bolt knob 58. This lateral attachment of the protractor body to the ruler member is indicative of the previously referred to prior art attachments.

Figure 6:
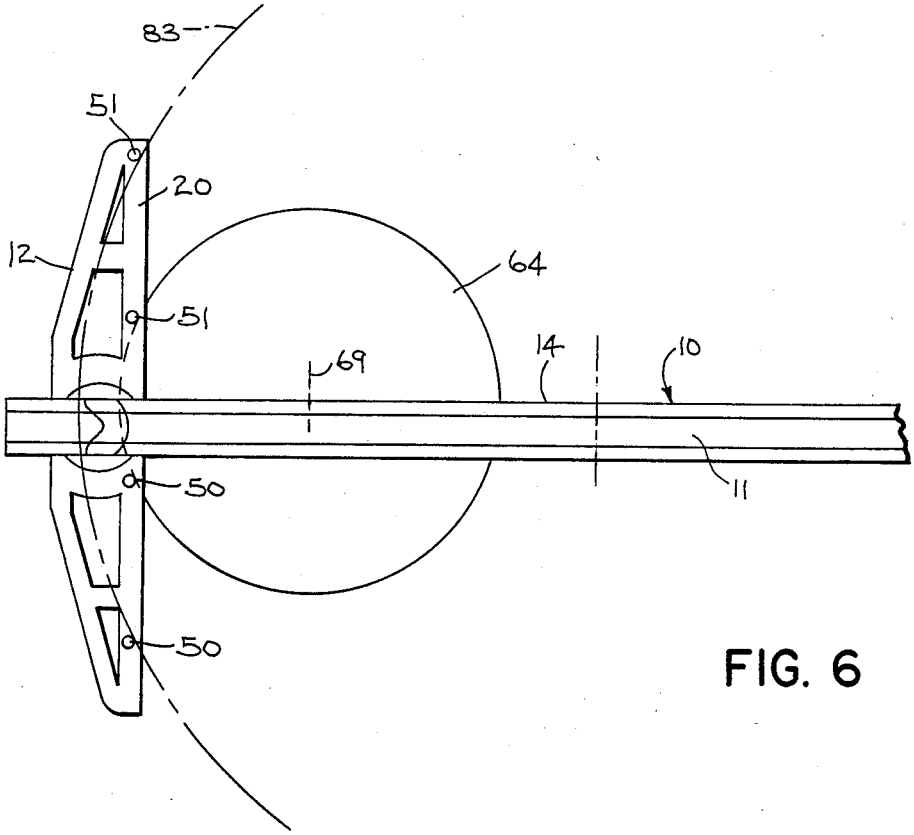
FIG. 6 is a top plan view illustrating the use of the improved carpenter square and protractor device of this invention in locating the centers of circular objects.

FIG. 6 illustrates the use of the improved square and protractor device 10 in finding the center of the rounded tables 64 and 83. It will be seen that pairs of the projections 50 and 51 are frictionally engaged in the aperatures 74 and 73, respectively and that additional paired apertures 75 and 76 are provided in the wall 20 (See also FIGS. 1, 2 and 3) and project transversely therefrom for purposes as will be later described in the operation to follow. They are spaced in a paired manner equidistantly and opposite to straight edge 14.

OPERATION

A better understanding of the advantages of the improved combination square and protractor device 10 will be had by a description of its operation. The improved square 10 will be in an assembled condition as shown in FIG. 1 with the screw 39 and the nut 37 providing initial frictional retention and location between the rotatable body 32 and the housing 33. In many instances it is difficult to measure angles for cutting large surfaces of panelling such as stairways, rafters, exposed ceilings, etc. This is accomplished initially by removing the protractor square 13 and measuring the desired angle. When this is done, the T-head member 12 can be adjusted to duplicate this angle onto the panel board to be cut. It will be appreciated that those markings 67 on the central housing 33 of the protractor means would be numerical designations. It will be further understood that rotatable body portion 32 will be held in a stationary manner with respect to the ruler member 11 as it is fastened thereto in a nonrotatable manner by the engagement of the slide member 29 and the guide walls 81 and 82. This will allow rotation of the housing 33 in relation to the body portion 32 and consequently the T-head member 12 which with respect to the arrows 68 will indicate the desired angle of the straight edge 19 in relation to the straight edges 14 and 15 of the ruler member 11. For example, as the T-head member 12 is so aligned with the ruler member 11 in FIG. 1, this would indicate a 90° or right angle relationship. The desired marking would then be made onto a panel board and the panel board cut accordingly.

An important feature of the improved square 10 as previously described is in the accurate duplication of the desired angle marked on the panel board. It will be appreciated that once the desired angle is located with respect to the ruler member 11 and the T-head 12 by rotation thereof, it becomes necessary to tighten the T-head member 12 against the ruler 11. This is accomplished by merely tightening the bolt 45 with respect to the nut 41 which will cause the ruler 11 to be pulled against the body portion 32. At the same time, body portion 32 and housing 33 will be rendered stationary as body portion 32 is forced against the stationary guide plate 30. During this tightening action, it will be seen that the pulling force of the bolt knob 45 will be transverse with respect to the longitudinal axis of the T-head member 12 and also centered in the ruler member 11. Accordingly it will be transverse with respect to the plane of rotation of the T-head member and the ruler member. This affords an accurate positioning of the T-head 12 with respect to the ruler member 11 as it is secured thereto.

In contrast, the lateral tightening of a square head such as 56 to the ruler does not afford such accuracy. This type of side adjustment and tightening is commonplace in many square ruler or protractor arrangements. Problems arise in that during the tightening of the adjustment bolt, inaccuracies can occur because of the pulling action from the side of the ruler with respect to the protractor or a square head member. These inaccuracies become even greater as the adjustment bolt head and the slot in the ruler become worn due to extensive usage. In having the pulling action or tightening action of the adjustment bolt centered and transverse to the ruler member and T-head member, these inaccuracies are avoided. As indicated earlier, a small degree of error where the angle is to be duplicated and extended over a large surface can cause serious problems.

Another advantage of the improved square 10 is seen in conjunction with FIG. 6 where it can accurately measure the center of round objects such as tables 64 and 83. In one instance the projections 50 and 51 will extend from the wall 20 and be located in a frictional manner in apertures such as 74 and 73 which are spaced equidistantly and oppositely from blade straight edge 14. The projections 50 and 51 will be located against the outer circular surface of the table 64 and a line will be drawn along the straight edge 14 which extends an equal distance from the projections. The improved square 10 will then be rotated 90° and another line drawn in a similar manner. Where these lines intersect will indicate the center 69 of the table. It will be seen in conjunction with the T-head 12 that additional apertures 75 and 76 are provided in the wall 20. Positioning of the projections 50 and 51 such as in apertures 76 and 75, respectively, will provide for the finding of center of a larger diameter table 83 in the previously indicated manner.

Another advantage of the improved square 10 is the angular and offset configuration of the slide member 29. It will be seen that this positioning places central portion 52 out of alignment with nut 41. This affords ease of fabrication and assembly.

It will be further appreciated that the T-head member 12 can be removed from the ruler member 16 to be used as an independent level or plumb. The ruler member 16 can also be employed independently of the T-head member 12 as can the protractor-square 13. These functions could be eliminated and the unique attachment means between the T-head member 12 and the ruler member 16 still would be accomplished.

In the preferred manner, the T-head member is formed from a dimensionally stable foamed material as described in U.S. Pat. No. 4,125,490. If desired, other materials could be utilized whether of a resinous plastic material or metal and still be operable to obtain the adjustment accuracy bolt feature for the improved square as previously described. The ruler member is formed from aluminum. However, if desired, other metals such as steel or rigid plastic could be utilized.

It would thus be seen that through the present invention there is now provided an improved carpenter square and protractor wherein desired angles can be accurately duplicated onto other surfaces for subsequent procedures. The improved square can be manufactured in an efficient manner from existing materials without special tooling and without the requirement for close tolerances in the component parts. Further, the improved square can be easily assembled and lends itself to a multifunction device in its ability to have associated components operating with it.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. An improved layout square device for accurately duplicating the marking of an angle onto a surface comprising:

a first elongated member having a flat surface along a longitudinal axis, with a straight edge adjacent thereto;

a second member also having a longitudinal axis and defining at least one straight edge;

rotatable protractor means operatively associated with said first and second members and providing rotation in a given plane; and draw bolt adjustment means defined by guide slot means having a T-shaped configuration operatively positioned in one of said first or second members, a bolt having a head and neck portion of a similar configuration for slidable engagement therein and a nut for engagement with said bolt, said bolt and nut arranged to threadably secure said first and second members together in a substantially transverse manner with respect to said plane of rotation.

2. The improved device according to claim 1 wherein said first member is further defined by a ruler member and said slot means is located therein.

3. The improved device according to claim 2 wherein said second member is further defined by an elongated head member with said protractor means operatively mounted thereon and a slide member positioned outwardly from said rotatable protractor means for reception of said first member and in an offset manner with respect to a connection of said bolt and nut.

4. The improved device according to claim 3 wherein said protractor means includes a rotatable member and a protractor scale and further includes an adjustment means operatively associated with said rotatable member to initially locate said rotatable member.

5. The improved device according to claim 3 wherein said slide member is defined by at least one spaced arm member extending in an angular manner with respect to said rotatable member.

6. The improved device according to claim 5 wherein said first member is defined by a beveled blade having opposing straight edges, a central flat portion and angular shoulder portions extending between said central portion and said straight edges, and said slide member is defined by two outwardly extending and angled arm members and an interconnecting arm member, said arm members constructed and arranged to accommodate said beveled blade between said slide member and said rotatable protractor means.

7. The improved device according to claim 2 wherein said second member is further defined by at least one wall member extending in a plane substantially parallel to said straight edge of said second member and at least two projections extending from said wall member in a substantially transverse manner, said projections spaced equidistantly and oppositely from said straight edge of said first member.

8. The improved device according to claim 7 further including a level vial member operatively positioned with respect to said wall member and said straight edge of said second member.

9. The improved device according to claim 8 further including a second wall member extending transversely from said first wall member and including a plumb vial operatively positioned with respect to said second wall member.

10. A multifunctional square and protractor device for accurately duplicating the marking of an angle onto a surface comprising:

a blade member having a flat surface along a longitudinal axis and at least one straight edge;

a head member also having a longitudinal axis and at least one straight edge;

rotatable protractor means including a compartment in said head member with a rotatable member operatively positioned therein and providing rotation in a given plane;

slide member means extending from said rotatable member and positioned to hold said blade member thereover in a substantially centered manner; and draw bolt adjustment means operatively positioned in a substantially transverse manner with respect to the plane of rotation of said blade member and said head member defined by guide slot means operatively positioned in one of said blade or head members, a bolt slidably mounted in said slot means and a nut for engagement with said bolt, said bolt and nut arranged to threadably secure said blade and head members together.

11. The multifunctional square and protractor device according to claim 10 wherein said head member is further defined by at least one wall member extending in a plane substantially parallel to said straight edge of said head member and at least two pairs of projections extending from said wall member in a substantially transverse manner, each said pair of projections being spaced equidistantly and oppositely from said straight edge of said blade member.

12. The multifunctional square and protractor device according to claim 10 wherein said slot means is of a T-shaped configuration and said bolt has a head and neck portion of a similar configuration for slidable engagement therein.

13. The multifunctional square and protractor device according to claim 12 wherein said rotatable protractor means is mounted in said head member, said slot means is positioned in said blade member, said bolt head is positioned in said slot means and said nut threadably engages said bolt opposite a scale portion of said protractor means of said head member opposite said blade member.

14. The multifunctional square and protractor device according to claim 13 wherein said slide member means includes arm members for reception of said blade member and in an offset manner with respect to a connection of said bolt and nut.

15. The multifunctional square and protractor device according to claim 14 wherein said blade member is defined by a beveled blade having opposing straight edges, a central flat portion and angular shoulder portions extending between said central portion and said straight edges, and said slide member means includes two outwardly angled arm members and an interconnecting arm member, said arm members constructed and arranged to accommodate said beveled blade between said slide member and said rotatable protractor means.

16. The mutlifunctional square and protractor device according to claim 13 wherein an additional protractor device having a draw bolt adjustment is secured in part by means of said slot means in said blade member.

* * * * *